United States Patent [19]

Mancini

[11] 4,441,618

[45] Apr. 10, 1984

[54] CONTAINER CHUTE FOR FAST RECEPTION OF NESTED CONTAINERS

[75] Inventor: Derek V. Mancini, Markham, Canada

[73] Assignee: Consumers Glass Company Limited, Etobicoke, Canada

[21] Appl. No.: 310,981

[22] Filed: Oct. 13, 1981

[51] Int. Cl.[3] ..... A47F 1/00

[52] U.S. Cl. ..... 211/49 D; 221/310

[58] Field of Search ..... 211/49 D, 15; 312/42, 312/43, 49; 221/310, 307, 241

[56] References Cited

U.S. PATENT DOCUMENTS

| | | | |
|---|---|---|---|
| 888,539 | 5/1908 | Simpson | 211/49 D |
| 1,496,491 | 6/1924 | Ringler | 221/307 |
| 1,541,532 | 6/1925 | Simmons | 312/43 X |
| 3,057,515 | 10/1962 | Loeser | 221/241 X |
| 3,165,233 | 1/1965 | West | 221/241 X |
| 4,206,954 | 6/1980 | Koolman | 211/49 D X |
| 4,354,605 | 10/1982 | Brutsman | 211/49 D |

*Primary Examiner*—Ramon S. Britts
*Assistant Examiner*—Robert W. Gibson, Jr.
*Attorney, Agent, or Firm*—Sim & McBurney

[57] ABSTRACT

A container chute according to the present invention utilizes movable portions which are normally biased to the closed position but may be moved outwardly to facilitate insertion of a stack of nested containers into the container chute. The container chute is normally used in automated packaging machines which use preformed nested containers. This approach simplifies the container loading operation giving the operator additional time for other responsibilities.

10 Claims, 4 Drawing Figures

CONTAINER CHUTE FOR FAST RECEPTION OF NESTED CONTAINERS

FIELD OF THE INVENTION

This invention relates to an apparatus for loading a stack of containers into a chute which holds the stack and allows containers to be dispensed from the bottom of the stack.

BACKGROUND OF THE INVENTION

With the advent of high speed container filling machines, such as those used in the filling of coffee creamer containers, condiment containers, small serving deserts, fruit cups and yogurt containers, it has become desirable for each operation of the filling machine to be simplified to allow the operator sufficient time to observe the performance of the machine. One of the functions that the operator must monitor is the container supply system and, as this supply becomes low, new containers must be added. As the output capacity of these machines continues to increase, the time required to maintain a supply of containers in the chutes increases and, therefore, the method of loading the containers into the chutes should be simplified where possible. As the size of the contaienrs increases, the rigidity of the stack similarly increases, and facilitates improved handling of the containers.

The simplest and most common method of loading containers into chutes on automatic filling machines is by top entry into a stationary chute which requires the entire stack to be raised to the upper part of the chute and placed in the opening for slid insertion within the chute enclosure. Although this system is satisfactory for many applications, it can prove difficult in that the operator must reach to the upper portion of the chute, maintaining control over the stack of containers and, therefore, the size of the chute is certainly limited.

To overcome this problem, various arrangements have been used which allow the stack of containers to be positioned horizontally and subsequently moved to the vertical position within chutes. One such structure is shown in U.S. Pat. No. 4,077,180, in which individual rows of containers are placed one by one into a hopper provided on an upright conveyor system which conveys individual stacks of containers upwardly to an area which is aligned with tubes which lead to the filling machine chutes. The stacks of containers are pushed through the tubes downwardly into the chutes to provide a supply of containers. This system is particularly suitable for small coffee creamer containers, where the output speed of the machine is high and, therefore, the additional cost is automating the container feed system is justified.

A slightly different approach is taken in our copending Canadian patent application Ser. No. 344,142, filed Jan. 22, 1980 entitled "Automatic Container Feed for Container Handling Device", in which stacks of containers are placed on a horizotal conveyor bed and moved to align with supply chutes of the automatic filling machine for advancement through a sidewall opening in the container chute and subsequently dropped within the supply chute for dispensing. Again, this automatic approach is particularly suited to high speed filling machines in which the output rate is sufficiently high to justify this mechanized approach.

Another prior art structure for use with small creamer containers utilizes a hinged horizontal platform on which stacks of containers are placed, with this platform being moved upwardly to cooperate with other support members which, in combination with the hinged member, define the chutes for the machine.

The present invention provides a simple mechanical apparatus which facilitates load of containers into chutes of an automatic filling machine.

SUMMARY OF THE INVENTION

A container chute for maintaining nested containers in a generally vertical manner to allow the containers to be dispensed with the assistance of gravity comprises support means positioned to positively maintain such containers in a generally vertical manner, a portion of said support means being movable to an open position to allow insertion of a stack of containers into said support means. The movable portion is then returned to a closed position to positively maintain such inserted stack. Therefore, according to the invention a major portion of the stack of containers passes laterally into the cavity defined between these support means as a portion of the support means is moved or cammed outwardly. Once the stack is inserted, the support means is returned to the initial position thereby positively maintaining the inserted stack of containers.

According to an aspect of the invention, the movable portion of the support means is biased to return to the closed position after the insertion of the stack into the chute.

According to a further aspect of the invention, the movable portion is cammed outwardly by pressing a stack of nested containers thereagainst, thereby creating an opening of sufficient size to allow the containers to pass through into the chute defined by the support means.

According to yet a further aspect of the invention, a container chute for receiving and maintaining nested containers in a generally vertical manner, comprises at least three supports positioned to maintain a stack of containers therebetween, wherein one of said supports is movable outwardly away from the other supports to define a larger opening for inserting such stack of containers into the chute. The movable support remains generally parallel to the other supports during movement thereof and remains in contact with the side of such column of containers during insertion of the containers into the chute.

BRIEF DESCRIPTION OF THE DRAWINGS

Preferred embodiments of the invention are shown in the drawings wherein.

DETAILED DESCRIPTION OF THE PREFERRED EMBODIMENTS

Figure 1:
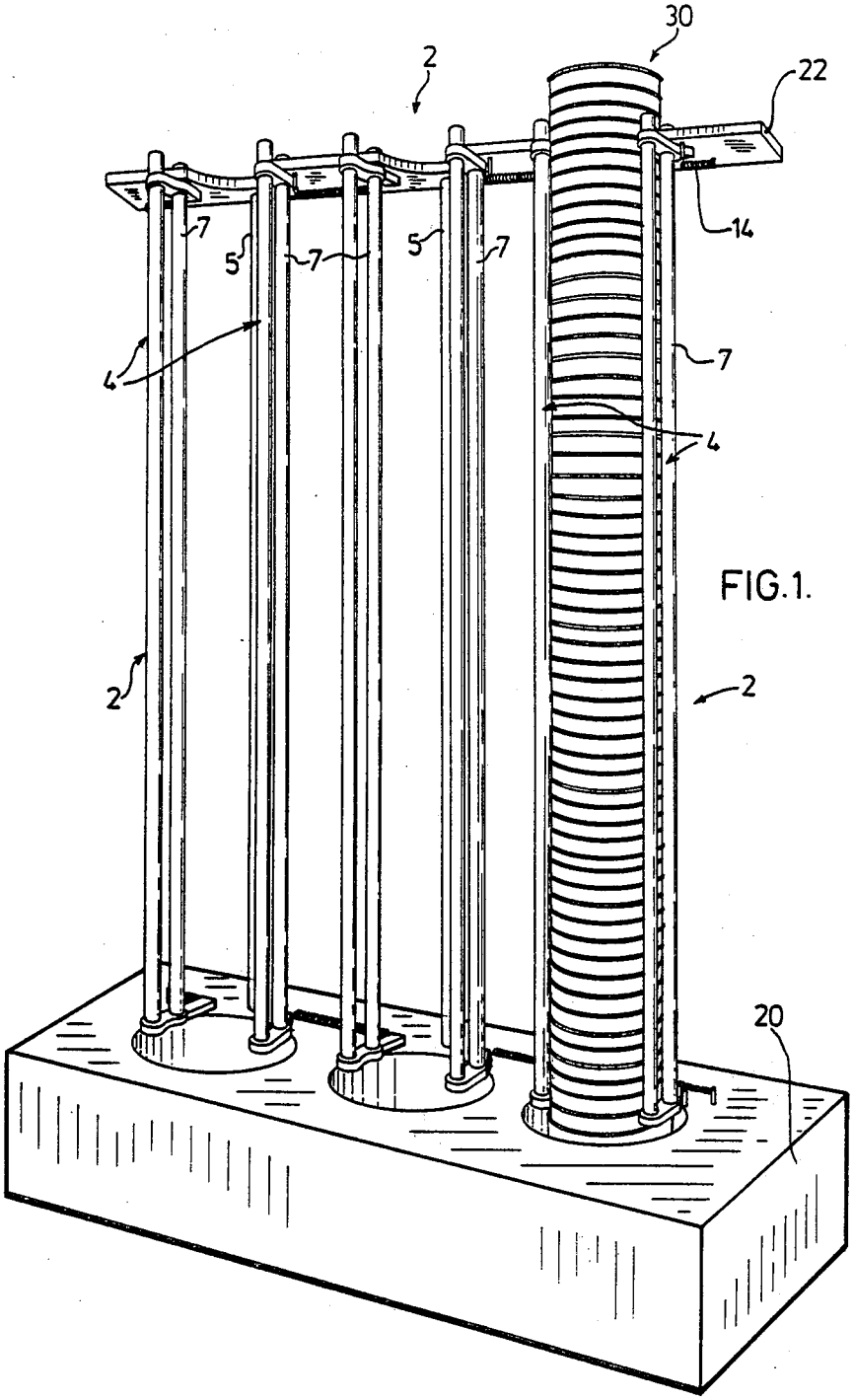
FIG. 1 is a perspective view of three container chutes commonly mounted on a base member.

Three container chute assemblies according to the present invention are shown in FIG. 1 commonly mounted on a base member 20. Each of these chutes 2, have a pair of moveable portions 4 located either side of a stationary support rod 5. The moveable portions 4 which partially define the container chute are pivotable about rod 7 which may be either directly secured to the base member or may be pivotally secured within the base member and the upper support member 22 such that these moveable portions do pivot about its longitudinal axis. Associated with each of these moveable portions 4 is a spring member 14 which urges the associated moveable portion to the closed position about a stack of nested containers generally shown as 30 in FIG. 1.

Figure 2:
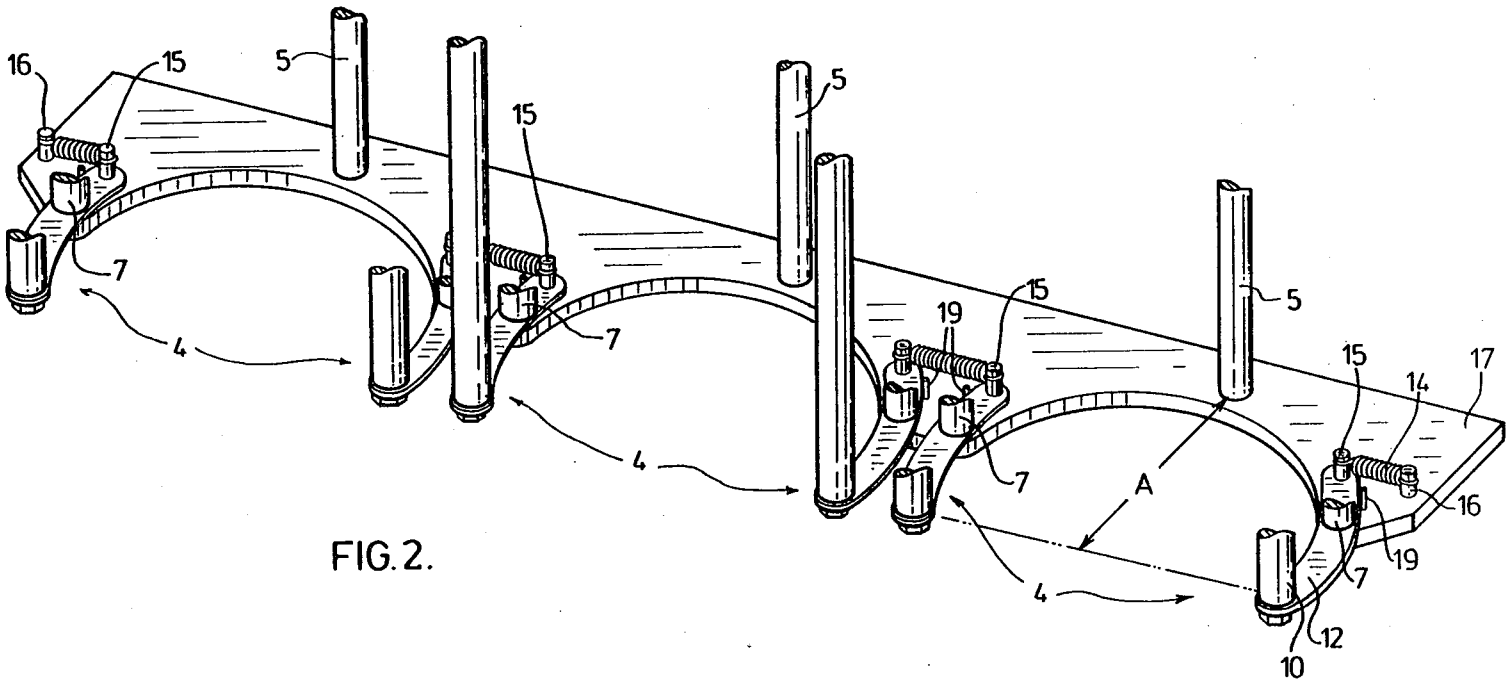
FIG. 2 is a partial perspective view of the lower support member of the container chutes.

Turning to FIG. 2 it can be seen that a base member 17 has been used in place of the block member 20 and supports the moveable portions 4 and the rear support rod 5 which in combination, generally define the container chute. Each of these moveable portions has an arm 12 pivotally secured to the base member 17 generally beneath rod 7 with rod 10 extending upwardly from the arm 12. This arm also extends beyond support rod 7 to cooperate with a spring member 14 which is secured to the arm 12 through a pin member 15 and the spring is secured to the base member 17 through pin 16. This spring urges the moveable member to the closed position shown in FIG. 2 which is positively defined by the stop pin 19 secured to the base member. Supports rods 10 on corresponding moveable portions 4 in combination with a stationary support rod 5 define the container chute and the spacing between any of these rod members is less than the maximum diameter of the containers to be inserted into the chute such that in the closed position a stack of containers is positively maintained within the chute. It can also be appreciated that the distance 'A' shown in FIG. 2 is greater than the radius of the containers such that rods 5 and 10 are positioned about the stack of containers and positively maintain the stack within the chute.

Figure 3:
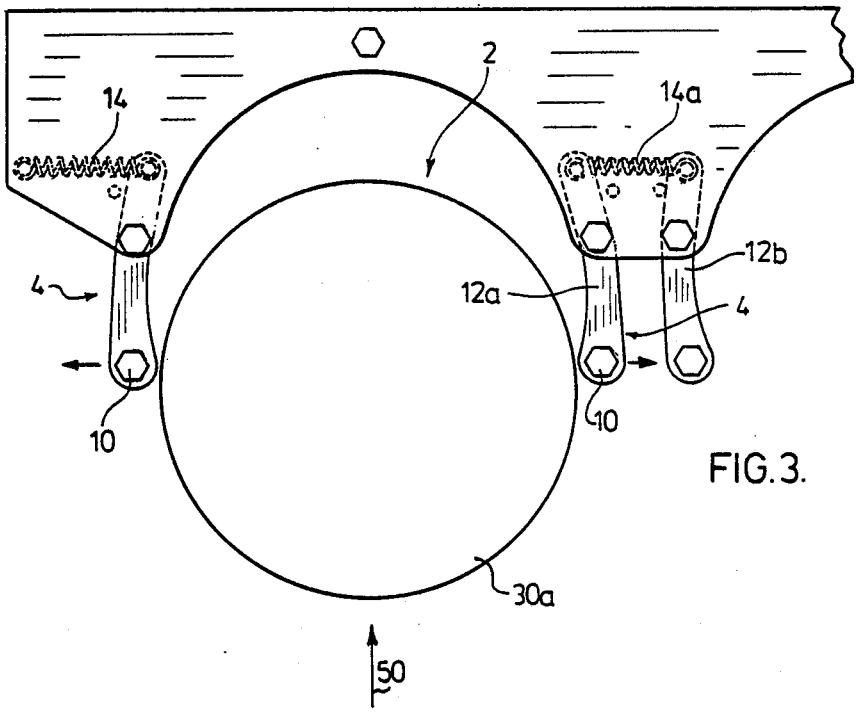
FIG. 3 is a top view of a container chute with a stack of containers being inserted into the chute.

The top view of FIG. 3 illustrates the insertion of a stack of containers 30*a* into the chute 2 with each of the moveable portions 4 camming outwardly such that the distance between the rods 10 on either side of the containers is sufficient to allow insertion of the containers into the chute. The operator merely has to press the stack of containers against these moveable portions and the interaction of the containers with the rods 10, if the operator applies pressure in the lateral direction of arrow 50, will force these moveable portions outwardly and the containers may be conveniently placed within the chute.

Figure 4:
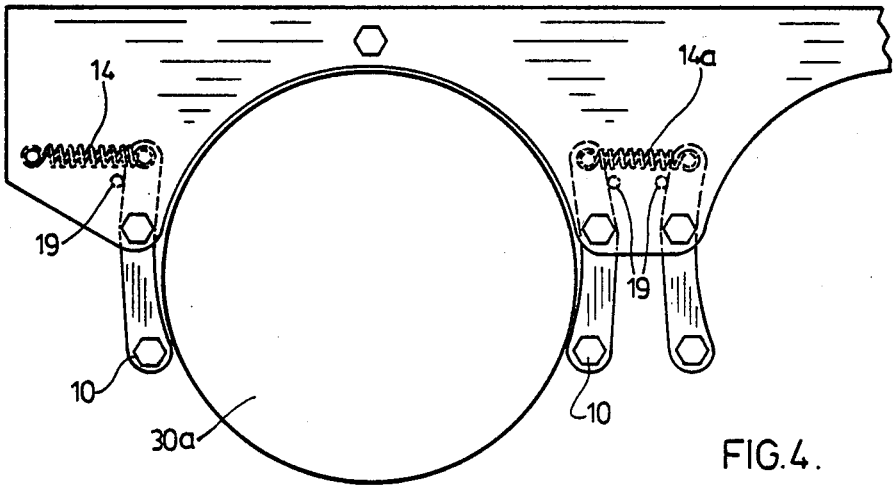
FIG. 4 is similar to FIG. 3 however the containers are now positioned within the chute member.

FIG. 4 illustrates the stack of containers 30*a* positioned within the chute member and the spring 14 urges the rod 10 to move inwardly after the maximum diameter of the container has passed through the gap between these rods. Stop pins 19 limit the movement of rods 10 towards each other and in so doing define a container chute which loosely maintains the stack of containers such that the containers can move under gravity downwardly as containers are dispensed from the bottom of the chute. The support rods which define the container chute should not have projecting edges which possibly could interact with the containers and bind them within the chute.

As shown in FIGS. 3 and 4 it is also possible that one spring member 14*a* may be connected to the adjacent arm 12 of the next container chute whereby the requirement for pins 16 for these arms is eliminated. As shown in FIG. 3, during the insertion of the stack of containers 30*a* into the container chute, arm 12*b* remains in its closed position while arm 12*a* is cammed outwardly due to the interaction of the stack of containers as it is pushed into the container chute.

As can be seen in FIGS. 1 and 2 the moveable portions of the container chutes and particularly the rods 12 are secured such that during insertion of a stack of containers these moveable portions cam outwardly while remaining generally parallel with the stationary support member 5. After the containers have been inserted into the chute these members again move inwardly towards one another and in the closed position, positively maintain the stack of containers therein.

The spacing between two adjacent arms of the moveable portions 12*a* and 12*b* shown in FIGS. 3 and 4 is sufficient to allow camming of this arm outwardly without interfering with the adjacent arm which remains in the closed position. If these arms were too close together they would interfere with the movement of each other and would not function in the manner shown.

Although we have shown a container chute having two moveable portions, it can easily be appreciated that one of these moveable portions could be stationary with the other moveable portion being cammed outwardly through a greater distance to allow the insertion of the containers. When two moveable portions are used the movement of each of these is reduced.

In all cases the movable portions of the container chute need not extend over the entire height of the chute. A stack of nested containers generally has some flexibility along its length which would allow the moveable portion of the chute to be reduced to a length less than the height of the stack being inserted with this stack being pressed inwardly and upwardly whereby the top of the stack moves above the movable portions within the chute to allow the lower portion of the stack to be inserted into the chute. This is not the preferred embodiment as it complicates the insertion of containers into the chute however it may be suitable in some operations.

Although preferred embodiments of the invention have been described herein in detail it will be understood that variations may be made thereto without departing from the spirit of the invention or the scope of the appended claims.

The embodiments of the invention in which an exclusive property or privilege is claimed are defined as follows:

1. A container chute for maintaining nested containers in a generally vertical manner to allow such containers to be dispensed with the assistance of gravity, said chute comprising support means extending generally vertically positioned to positively maintain such containers in a generally vertical manner, said chute having an open bottom allowing said containers to be dispensed through said open bottom, a portion of said support means being movable outwardly of the chute to an open position to allow lateral insertion of a stack of containers into said support means whereupon said movable portion is returned to a closed position to positively maintain such inserted stack.

2. A container chute as claimed in claim 1, wherein said movable portion of said support means is biased to return to said closed position after insertion of said containers.

3. A container chute as claimed in claim 1 or 2, wherein said movable portion is cammed outwardly by pressing a stack of nested containers laterally thereagainst to define an opening into said support means of sufficient size to allow such containers to pass through said opening and into said support means.

4. A container chute for receiving and maintaining nested containers in a generally vertical manner, comprising at least three generally vertically extending support rods positioned to maintain a stack of containers therebetween, said rods forming an open bottom chute allowing said containers to be dispensed through said open bottom, wherein one of said support rods is movable outwardly away from the other support rods to define a larger opening for laterally inserting such stack of containers into the chute, said movable support rod remaining generally parallel to the other support rods during movement thereof.

5. A container chute as claimed in claim 4, wherein two of said support rods are movable to define a variable opening therebetween for receiving such container stack.

6. A container chute as claimed in claim 5, wherein said movable support rods are spring biased to a closed position where the support rods are positioned for maintaining an inserted stack of containers.

7. A container chute as claimed in claim 6, wherein each of said movable support rods is secured by an arm pivotally secured to a base member which allows outward movement of said movable support rods during insertion of such stack of containers into said chute.

8. A container chute as claimed in claim 7, wherein each arm of said movable support rods includes an extension and an associated spring means which urges said support rod to close about a column of containers when inserted therein.

9. A container chute as claimed in claim 8, wherein said spring means is an expansion spring and a stop is provided for limiting the movement of said arm inwardly to thereby define the closed position of said movable support rods whereby the space between support rods is less than the maximum width of such containers and wherein the maximum space between said movable supports is greater than the maximum container width, said movable support rods camming outwardly when contacted by a stack of containers being pushed therebetween.

10. In an automatic packaging machine for packaging food products into preformed frusto conical containers, a container support and supply arrangement for receiving a stack of containers and dispensing them to a conveyor comprising a support member and two adjacent supports one of which is biased to a closed position, whereby said forming an open bottom chute supports positively maintaining a column of nested containers therebetween, such containers being dispensed through said open bottom of the chute as required, with the remaining containers dropping under the influence of gravity, said biased support being movable outwardly away from the support members to an open position whereby a column of containers may be laterally inserted between said supports and subsequently maintained therein when said support returns to the closed position.

* * * * *